US008941629B2

(12) United States Patent
Park et al.

(10) Patent No.: US 8,941,629 B2
(45) Date of Patent: Jan. 27, 2015

(54) SCAN DRIVER AND ORGANIC LIGHT EMITTING DISPLAY DEVICE USING THE SAME

(75) Inventors: Hyemin Park, Changwon-si (KR); Sangho Yu, Paju-si (KR); Hyunwook Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 127 days.

(21) Appl. No.: 13/595,261

(22) Filed: Aug. 27, 2012

(65) Prior Publication Data

US 2013/0050161 A1 Feb. 28, 2013

(30) Foreign Application Priority Data

Aug. 29, 2011 (KR) ..... 10-2011-0086279

(51) Int. Cl.
*G09G 5/00* (2006.01)
*G09G 3/30* (2006.01)

(52) U.S. Cl.
CPC ... *G09G 3/30* (2013.01); *G09G 5/00* (2013.01)
USPC ..... 345/204; 345/76

(58) Field of Classification Search
None
See application file for complete search history.

(56) References Cited

U.S. PATENT DOCUMENTS

| | | | | |
|---|---|---|---|---|
| 8,077,168 | B2 * | 12/2011 | Shin | 345/204 |
| 2005/0134545 | A1 | 6/2005 | Jang et al. | |
| 2006/0238454 | A1 * | 10/2006 | Wang et al. | 345/72 |
| 2009/0256785 | A1 * | 10/2009 | Sung et al. | 345/77 |
| 2011/0115761 | A1 * | 5/2011 | Takei et al. | 345/204 |
| 2012/0050234 | A1 * | 3/2012 | Jang et al. | 345/204 |

FOREIGN PATENT DOCUMENTS

CN 1629925 A 6/2005

OTHER PUBLICATIONS

State Intellectual Property Office of the People's Republic of China, First Office Action, Chinese Patent Application No. 201210309415.8, May 19, 2014, twelve pages.

* cited by examiner

*Primary Examiner* — Sumati Lefkowitz
*Assistant Examiner* — Douglas M Wilson
(74) *Attorney, Agent, or Firm* — Fenwick & West LLP

(57) ABSTRACT

A scan driver for an organic light emitting display includes logic circuitry to receive a plurality of start pulses and either a first clock or a second clock that is an inversion of the first clock and to generate one or more pulse signals as scan signals for driving the sub-pixels of the organic light emitting display panel, where one or more of the pulse signals are delayed by ½ horizontal time from at least another one of the pulse signals.

17 Claims, 6 Drawing Sheets

SCAN DRIVER AND ORGANIC LIGHT EMITTING DISPLAY DEVICE USING THE SAME

This application claims the benefit of Republic of Korea Patent Application No. 10-2011-0086279 filed on Aug. 29, 2011, which is hereby incorporated by reference.

BACKGROUND

1. Technical Field

The present invention relates to a scan driver and an organic light emitting display device using the same.

2. Description of the Related Art

As information technology develops, the market for display devices, which connect users with information, grows and as a result the use of display devices such as an organic light emitting display (OLED), a liquid crystal display (LCD), and a plasma display panel (PDP) has increased.

The display device is used in various industrial fields of a mobile phone or a computer such as a laptop computer as well as a household appliance field such as a television (TV) or a video recorder.

Some of the aforementioned display devices, for example, a liquid crystal display or organic light emitting display, comprise a panel comprising a plurality of subpixels arranged in a matrix form and a driver for driving the panel. The driver comprises a timing driver for controlling an externally supplied image signal, a scan driver for supplying a gate signal to the panel, a data driver for supplying a data signal to the panel, and so on.

A conventional scan driver outputs a scan signal as a waveform for 1 horizontal time (hereinafter, abbreviated as HT) period. When a compensation circuit for compensating transistors is included in the subpixels, as is the case of an organic light emitting display, a scan signal for ½ HT period may be used to drive the compensation circuit.

SUMMARY

Embodiments of the present disclosure relate to a scan driver for display devices that includes logic circuitry to receive a plurality of start pulses and either a first clock or a second clock that is an inversion of the first clock and to generate one or more pulse signals as scan signals for driving the sub-pixels of the organic light emitting display panel, where one or more of the pulse signals are generated to be delayed by ½ horizontal time from at least another one of the pulse signals. The display device may be an organic light emitting display, and the horizontal time may correspond to a duration during which the scan signals are asserted for display of an image on the organic light emitting display.

An exemplary embodiment of the present invention provides a scan driver comprising: clock selectors that output either a first clock or a second clock obtained by inverting the first clock in accordance with the logic value of a selection signal, the first clock having a logic high period followed by a logic low period within one horizontal time; and shift registers that generate pulse signals based on the first clock or the second clock supplied from the clock selectors together with first to N-th start pulses of different phases where N is an integer equal to or greater than 4. Selected one or more of the shift registers generate one or more pulse signals having a delay period of ½ horizontal time from at least another one of the pulse signals.

In another aspect, an exemplary embodiment of the present invention provides an organic light emitting display comprising: an organic light emitting display panel; a data driver that supplies data signals to the display panel; and a scan driver, the scan driver comprising clock selectors that output either a first clock or a second clock obtained by inverting the first clock in accordance with the logic value of a selection signal, the first clock having a logic high period followed by a logic low period within one horizontal time; and shift registers that generate pulse signals based on either the first clock or the second clock supplied from the clock selectors together with first to N-th start pulses of different phases where N is an integer equal to or greater than 4. Selected one or more of the shift registers generate one or more pulse signals having a delay period of ½ horizontal time from at least another one of the pulse signals.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EMBODIMENTS

Reference will now be made in detail to embodiments of the invention, examples of which are illustrated in the accompanying drawings.

Hereinafter, a concrete embodiment of the present invention will be described in detail with reference to the accompanying drawings.

Figure 1:
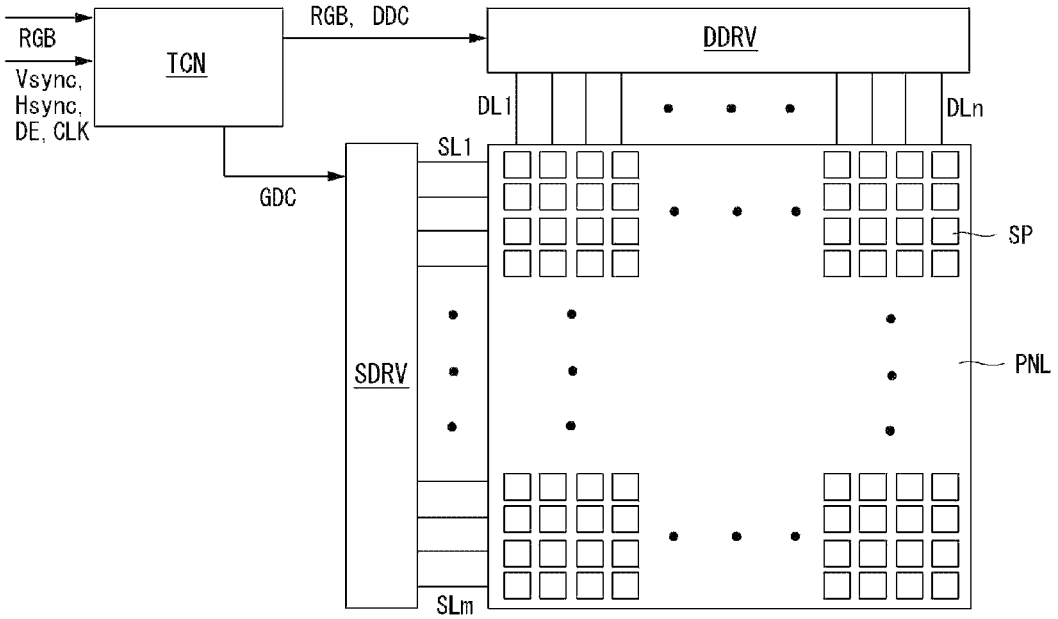
FIG. 1 is a schematic block diagram of an organic light emitting display.

FIG. 1 is a schematic block diagram of an organic light emitting display.

As show in FIG. 1, the organic light emitting display comprises a timing driver TCN, a display panel PNL, a scan driver SDRV, and a data driver DDRV.

The timing driver TCN receives a vertical synchronous signal Vsync, a horizontal synchronous signal Hsync, a data enable signal DE, a clock signal CLK, and data signals RGB from an external source. The timing controller TCN controls an operational timing of the data driver DDRV and the scan driver SDRV by using the timing signals such as the vertical synchronous signal Vsync, the horizontal synchronous signal Hsync, the data enable signal DE, and the clock signal CLK. In this case, because the timing driver TCN can determine a frame period by counting the data enable signal DE during one horizontal period, the vertical synchronous signal Vsync and the horizontal synchronous signal Hsync may be omitted. Control signals generated by the timing driver TCN may comprise a gate timing control signal GDC for controlling an operational timing of the scan driver SDRV and a data timing control signal DDC for controlling an operational timing of the data driver DDRV.

The display panel PNL comprises a display unit having subpixels SP disposed in a matrix form. The subpixels SP have a structure further comprising a compensation circuit including a transistor and a capacitor, in addition to a 2T1C (2 transistors and 1 capacitor) structure including a switching transistor, a driving transistor, a capacitor and an organic light emitting diode. The subpixels SP with the compensation circuit added thereto are configured in a structure comprising three or more transistors and one or more capacitors. The subpixels SP having such a configuration may be formed as top-emission type subpixels, bottom-emission type subpixels, or dual-emission type subpixels.

In response to the gate timing control signal GDC supplied from the timing driver TCN, the scan driver SDRV sequentially generates scan signals with a swing width with which the transistors of the subpixels SP included in the display panel PNL can operate. The scan driver SDRV supplies the scan signals through scan lines SL1 to SLm connected to the subpixels SP.

In response to the data timing control signal DDC supplied from the timing controller TCN, the data driver DDRV samples a digital data signal RGB supplied from the timing driver TCN and latches the same to convert it into data of a parallel data system. In converting the signal into the data of a parallel data system, the data driver DDRV converts the digital data signal RGB into a gamma reference voltage and then converts the gamma reference voltage into an analog data signal. The data driver DDRV supplies the data signal through data lines DL1 to DLn connected to the subpixels SP.

Hereinafter, the scan driver SDRV according to an exemplary embodiment of the present invention will be described in more detail.

Figure 2:
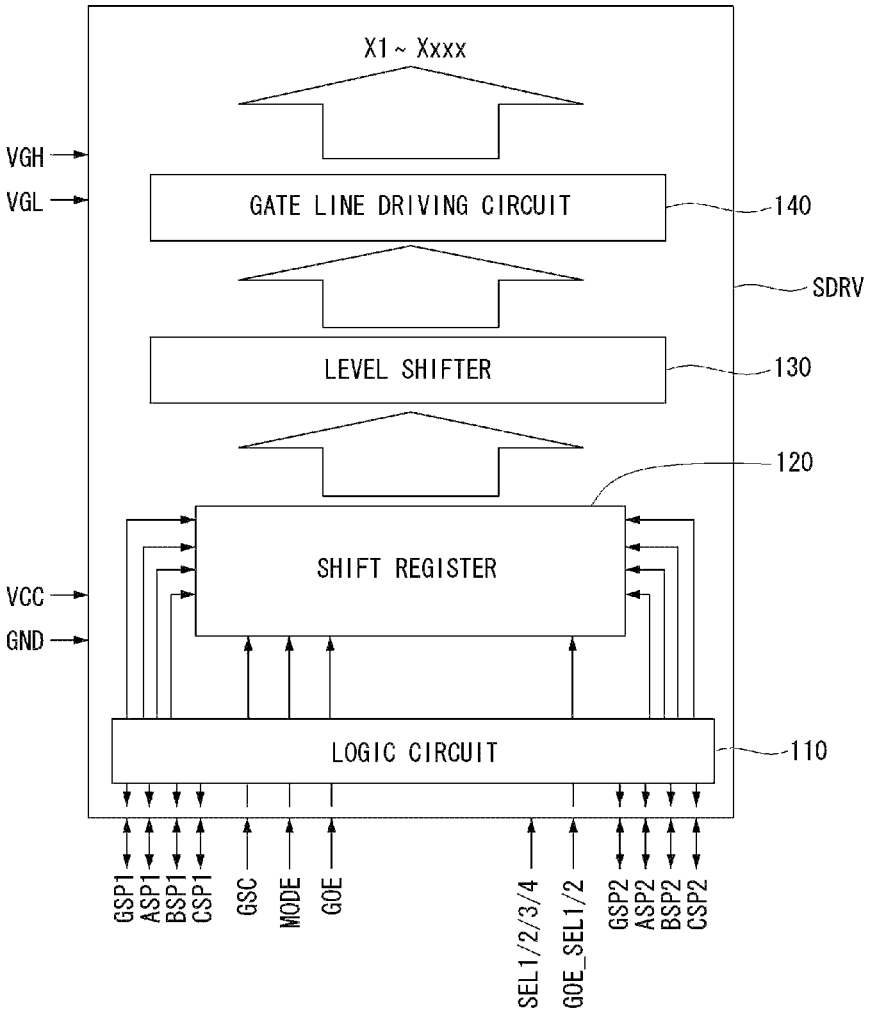
FIG. 2 is a schematic block diagram of a scan driver according to an exemplary embodiment of the present invention.
Figure 3:
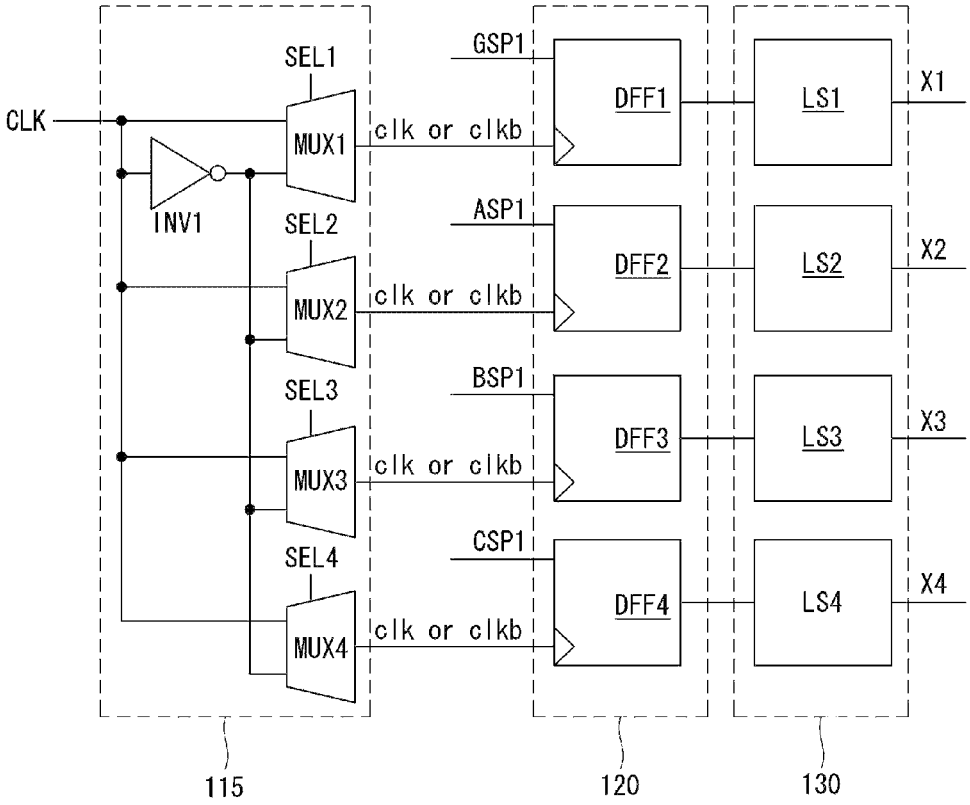
FIG. 3 is a block diagram showing parts of the scan driver shown in FIG. 2.
Figure 4:
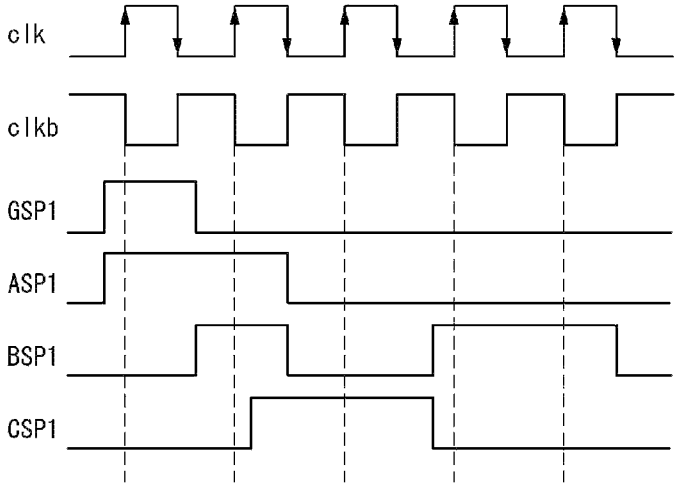
FIG. 4 is an illustration of the waveforms of clocks and start pulses supplied to the scan driver shown in FIG. 3.
Figure 5:
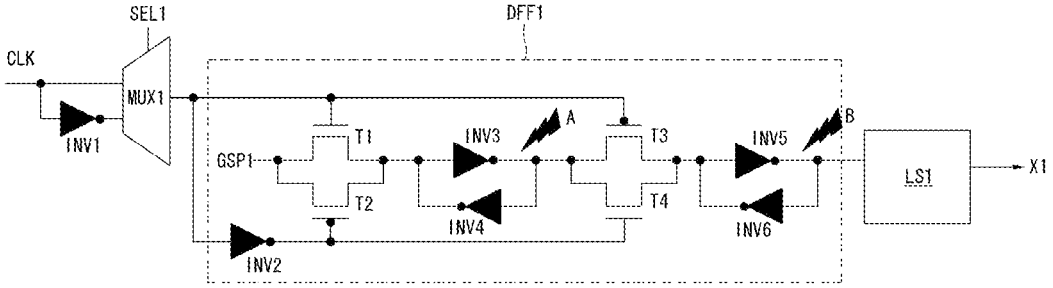
FIG. 5 is a block diagram showing part of the scan driver shown in FIG. 3.
Figure 6:
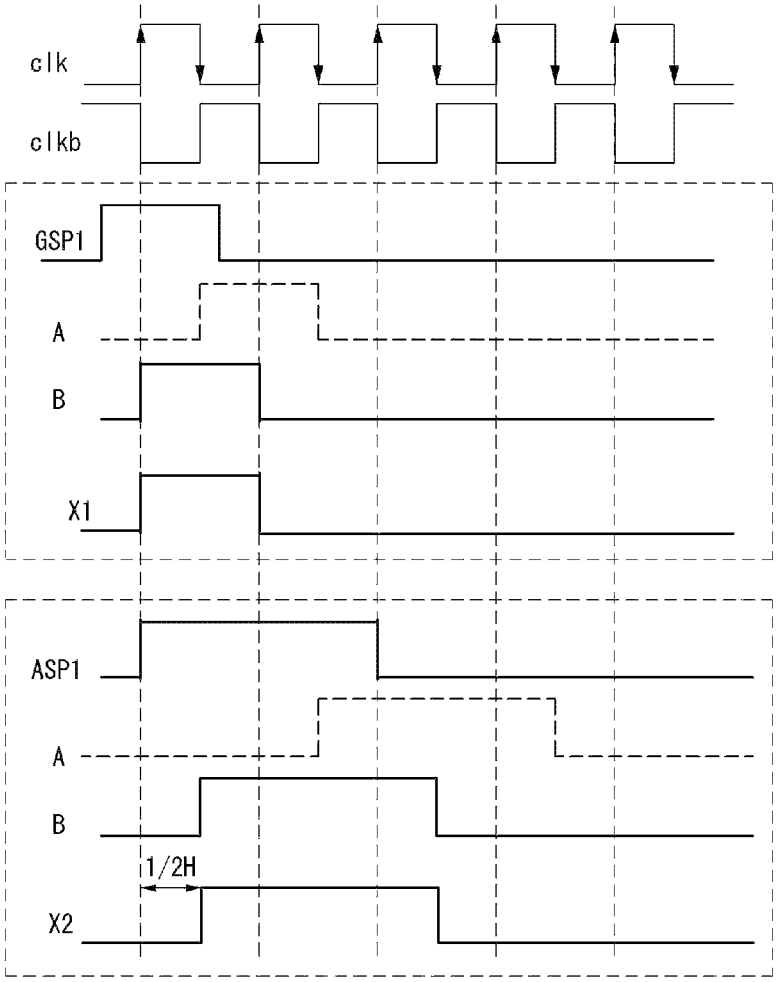
FIG. 6 illustrates the synchronization relationship between clocks and pulse signals depending on the logic value of a selection signal.
Figure 7:
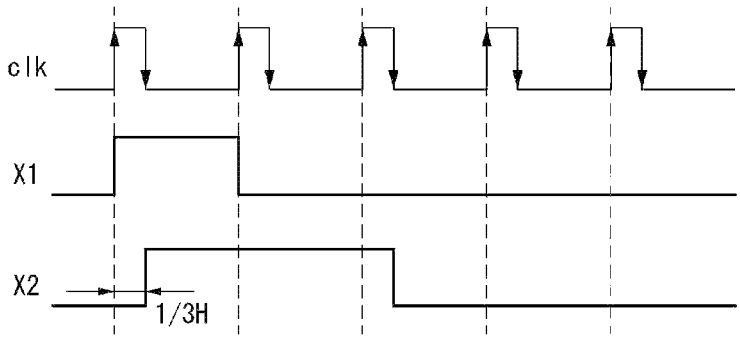
FIG. 7 illustrates a change in horizontal time period resulting from the control of the ON duty of a clock.

FIG. 2 is a schematic block diagram of a scan driver according to an exemplary embodiment of the present invention. FIG. 3 is a block diagram showing parts of the scan driver shown in FIG. 2. FIG. 4 is an illustration of the waveforms of clocks and start pulses supplied to the scan driver shown in FIG. 3. FIG. 5 is a block diagram showing part of the scan driver shown in FIG. 3. FIG. 6 is a view for explaining the synchronization relationship between clocks and pulse signals depending on the logic value of a selection signal. FIG. 7 illustrates a change in horizontal time period resulting from the control of the ON duty of a clock.

As shown in FIG. 2, the scan driver SDRV according to the exemplary embodiment of the present invention comprises logic circuits 110, shift registers 120, level shifters 130, and line driving circuits 140. The circuits included in the scan driver SDRV and signals supplied to terminals will be described below in brief.

The scan driver SDRV comprises a terminal for receiving start pulses GSP1, GSP2, ASP1, ASP2, BSP1, BSP2, CSP1, and CSP2, a terminal for receiving a data shift clock GSC, a terminal for receiving a mode signal MODE, a terminal for receiving a gate output enable signal GOE, a terminal for receiving selection signals SEL 1/2/3/4, a terminal for receiving a masking selection signal GOE_SEL 1/2 to mask the gate output enable signal, a terminal for receiving a first power supply voltage VCC, a terminal for receiving a second power supply voltage GND, a terminal for receiving a gate high voltage VGH, and a terminal for receiving a gate low voltage VGL.

The scan driver SDRV generates scan signals by using the data shift clock GSC, and the start pulses GSP1, CSP2, ASP1, ASP2, BSP1, BSP2, CSP1, and CSP2. The scan driver SDRV varies a scanning pattern and output selection bits in the 4-shift output mode and in the 3-shift output mode in response to the mode signal MODE. The scan driver SDRV controls the line driving circuits 140 by using the gate output enable signal GOE. The scan driver SDRV outputs either a first clock or a second clock obtained by inverting the first clock. The first clock has a logic high period followed by a logic low period within 1 horizontal time. The scan driver SDRV masks the gate output enable signal GOE in response to the masking selection signal GOE_SEL. The scan driver SDRV is driven based on the first power supply voltage VCC and the second power supply voltage GND. The scan driver SDRV increases the level of pulse signals generated by the shift registers 120 by using the gate high voltage VGH and the gate low voltage VGL.

The logic circuits 110 set a drive condition of the scan driver SDRV by using various signals supplied from an external source. The logic circuits 110 comprise circuits for setting the drive condition of the scan driver SDRV and clock selectors 115.

The shift registers 120 generate pulse signals by using the data shift clock GSC and the start pulses GSP1, GSP2, ASP1, ASP2, BSP1, BSP2, CSP1, and CSP2. The shift registers 120 comprise flip-flops formed separately for respective stages. The start pulses GSP1, GSP2, ASP1, ASP2, BSP1, BSP2, CSP1, and CSP2 comprise first through N-th (N is an integer equal to or greater than 4) start pulses of different phases. Hereinafter, the data shift clock GSC will be abbreviated as a clock (clk or clkb).

The level shifters 130 increase the level of pulse signals supplied from the shift registers 120 and output them as scan signals.

The line driving circuits 140 drive scan signals output through output terminals X1 to Xxxx, where "xxx" indicates the number of output terminals and X1 to Xxxx correspond to the number of scan lines of the display panel.

As shown in FIGS. 3 and 4, one stage of the scan driver SDRV comprises clock selectors 115, shift registers 120, and level shifters 130.

The clock selectors 115 and the shift registers 120 will be described below.

The clock selectors 115 output either a first clock clk or a second clock clkb obtained by inverting the first clock clk in accordance with the logic value of the selection signal SEL 1/2/3/4. The first clock has a logic high period followed by a logic low period within 1 horizontal time.

The clock selectors 115 comprise four 2-to-1 multiplexers MUX1 to MUX4. Each of the four multiplexers MUX1 to MUX4 having a first input terminal for receiving the first clock clk, a second input terminal for receiving the second clock clkb obtained by inverting the first clock clk and output through a first inverter INV1, a selection terminal for receiving the selection signal SEL 1/2/3/4, and an output terminal for outputting either the first clock clk or the second clock clkb in accordance with the logic value of the selection signal SEL 1/2/3/4 supplied to the selection terminal.

The shift registers 120 generate pulse signals by using either the first clock clk or the second clock clkb supplied from the clock selectors 115 and the first to fourth start pulses GSP1, ASP1, BSP1, and CSP1 of different phases. A selected one of the shift registers 120 generates a J-th pulse signal having a delay period of ½ horizontal time from the first pulse signal output from the shift registers 120.

The shift registers 120 comprise four D flip-flops DFF1 to DFF4 which delay the first to fourth start pulses GSP1, ASP1, BSP1, and CSP1 input into a data terminal GSP1, ASP1, BSP1, or CSP1 in accordance with either the first clock clk or second clock clkb input into a clock terminal, and output them as pulse signals.

When the first clock clk is supplied from the clock selectors 115, the shift registers 120 output a pulse signal in synchronization with a falling edge of the first clock clk, and when the second clock clkb is supplied from the clock selectors 115, they output a pulse signal in synchronization with a rising edge of the second clock clkb. That is, the scan driver SDRV is synchronized differently depending on the state of a clock output through the clock selectors 115.

The logic values of the selection signals SEL 1/2/3/4 supplied to the clock selectors 115 are set as shown in the following Table 1. Synchronization of outputs of the level shifters 130 in accordance with the logic value of the selection signal SEL 1/2/3/4 will be described in the following Table 2.

TABLE 1

| | | | | |
|---|---|---|---|---|
| SEL1 | 1 | 0 | 1 | 1 |
| SEL2 | 1 | 0 | 0 | 1 |
| SEL3 | 1 | 0 | 1 | 0 |
| SEL4 | 1 | 0 | 0 | 0 |

TABLE 2

| | state | output | description |
|---|---|---|---|
| selection signal SEL 1/2/3/4 | logic high | clk | output X is synchronized with falling edge of clk |
| selection signal SEL 1/2/3/4 | logic low | clkb | output X is synchronized with rising edge of clkb |

As shown in FIG. 5, the first D flip-flop DFF1 is connected to an output terminal of the first clock selector MUX1, and the first level shifter LS1 is connected to an output terminal of the first D flip-flop DFF1. The truth table of the first D flip-flop DFF1 is as shown in the following Table 3.

TABLE 3

| Input Data | Q (current output) | Q + 1 (next output) |
|---|---|---|
| 0 | 0 | 0 |
| 0 | 1 | 0 |
| 1 | 0 | 1 |
| 1 | 1 | 1 |

The first D flip-flop DFF1 comprises first to fourth transistors T1 to T4 and second to sixth inverters INV2 to INV6. The first D flip-flop DFF1 will be illustrated and described as having the following configuration by way of example, but is not limited thereto. Also, the second to fourth D flip-flops DFF2 to DFF4 of FIG. 3 may have the same configuration as the first D flip-flop. The configuration of the first to fourth D flip-flops DFF1 to DFF4 have been presented to better aid in the understanding of the shift registers. It should be noted that the present invention is not limited thereto, but rather could be configured in any other manner.

The first transistor T1 is an N type, its gate electrode is connected to the clock terminal supplied with the first clock clk or second clock clkb, its first electrode is connected to the data terminal supplied with the first start pulse GSP1, and its second electrode is connected to an input terminal of the third inverter INV3. The second transistor T2 is a P type, its gate electrode is connected to an output terminal of the second inverter INV2, its first electrode is connected to the data terminal, and its second electrode is connected to the input terminal of the third inverter INV3. The third transistor T3 is a P type, its gate electrode is connected to the clock terminal, its first electrode is connected to an output terminal of the third inverter INV3, and its second electrode is connected to an input terminal of the fifth inverter INV5. The fourth transistor T4 is an N type, its gate electrode is connected to the output terminal of the second inverter INV2, its first electrode is connected to the output terminal of the third inverter INV3, and its second electrode is connected to the input terminal of the fifth INV5.

An input terminal of the second inverter INV2 is connected to the clock terminal, and the output terminal thereof is connected to the gate electrode of the second transistor T2. The input terminal of the third inverter INV3 is connected to the second electrode of the first transistor T1, and the output terminal thereof is connected to the first electrode of the third transistor T3. An output terminal of the fourth inverter INV4 is connected to the input terminal of the third inverter INV3, and an input terminal thereof is connected to the output terminal of the third inverter INV3. The input terminal of the fifth inverter INV5 is connected to the second electrode of the third transistor T3, and an output terminal thereof is connected to an output terminal of the first D flip-flop DFF1. An input terminal of the sixth inverter INV6 is connected to the output terminal of the first D flip-flop DFF1, and an output terminal thereof is connected to the input terminal of the fifth inverter INV5.

As shown in FIGS. 3, 5, and 6, the first and second clock selectors MUX1 and MUX2, the first and second D flip-flops DFF1 and DFF2, and the first and second level shifters LS1 and LS2 output the following waveforms in accordance with a selection signal.

First, when a selection signal SEL1=0 corresponding to logic low is supplied to a selection terminal of the first clock selector MUX1, the first clock selector MUX1 outputs the second clock clkb through the output terminal.

Then, the first D flip-flop DFF1 latches the second clock clkb supplied to the clock terminal and the first start pulse GSP1 supplied to the data terminal, and outputs a first pulse signal synchronized with the rising edge of the second clock clkb. The first level shifter LS1 increases the level of the first pulse signal and outputs it as a first scan signal X1. In this process, the first D flip-flop DFF1 outputs the first pulse signal after a delay as shown in the waveforms of "A" and "B".

Next, when a selection signal SEL2=1 corresponding to logic high is supplied to a selection terminal of the second clock selector MUX2, the second clock selector MUX2 outputs the first clock clk through the output terminal.

Then, the second D flip-flop DFF2 latches the first clock clk supplied to the clock terminal and the second start pulse GSP2 supplied to the data terminal, and outputs a second pulse signal synchronized with the falling edge of the first clock clk. Then, the second level shifter LS2 increases the level of the second pulse signal and outputs it as a second scan signal X2. In this process, the second D flip-flop DFF2 outputs the second pulse signal after a delay as shown in the waveforms of "A" and "B".

As can be seen from the above explanation, in the scan driver SDRV of the exemplary embodiment, a start pulse supplied to the data terminal is synchronized with a rising edge or falling edge of the state of a clock supplied to the clock terminal. Accordingly, the scan driver SDRV of the exemplary embodiment can output the second scan signal X2, which is delayed from the first scan signal X1 by ½ horizontal time, by varying the state of a clock output through the clock selectors MUX1 to MUX4. Here, the horizontal time is the period during which a scan signal is asserted for display of an image on a display device such as an organic light emitting display. The terminals from which the first scan signal X1 and the second scan signal X2, which is delayed from the first scan signal X1 by ½ horizontal time, are not limited to the first level shifter LS1 and the second level shifter LS2.

In other words, selected ones of the first to fourth D flip-flops DFF1 to DFF4 included in the scan driver SDRV of the exemplary embodiment are associated with a logic value of high for the corresponding selection signals. On the other hand, the non-selected ones of the first to fourth D flip-flops DFF1 to DFF4 are associated with a logic value of low for the corresponding selection signals. The number of D flip-flops selected from the first to fourth D flip-flops DFF1 to DFF4 is M (M is an integer equal to or greater than 1). That is, if M=1, there is one scan signal delayed from a specific scan signal by ½ horizontal time, and if M=2, there are two scan signals delayed from a specific scan signal by ½ horizontal time.

Meanwhile, the foregoing explanation has been made on an example where the first clock clk and the second clock clkb have the same duty ratio (on time compared to off time) of logic high to logic low within 1 horizontal time. However, the first clock clk and the second clock clkb may have different duty ratios of logic high and logic low within 1 horizontal time. In this case, the selected one of the first to fourth flip-flops DFF1 to DFF4 can generate the J-th pulse signal having a delay period of 1/K (K is an integer equal to or greater than 3) from the I-th pulse signal.

For example, as shown in FIG. 7, if the on duty of the first clock clk is shorter than the off duty thereof, the second scan signal X2 has a delay period of ⅓ horizontal time from the first scan signal X1. It can be seen through the above description that the first scan signal X1 is output in synchronization with the rising edge and the second scan signal X2 is output in synchronization with the falling edge.

If the on/off duty ratio of the first clock clk is not limited to that of FIG. 7 but the on duty is further shortened, the second scan signal X2 may have a delay period of ¼ horizontal time. Accordingly, the scan driver SDRV of the exemplary embodiment can adjust the horizontal time of a scan signal so as to have a shorter delay period.

Hereinafter, an organic light emitting display using a scan driver according to an exemplary embodiment of the present invention will be described.

Figure 8:
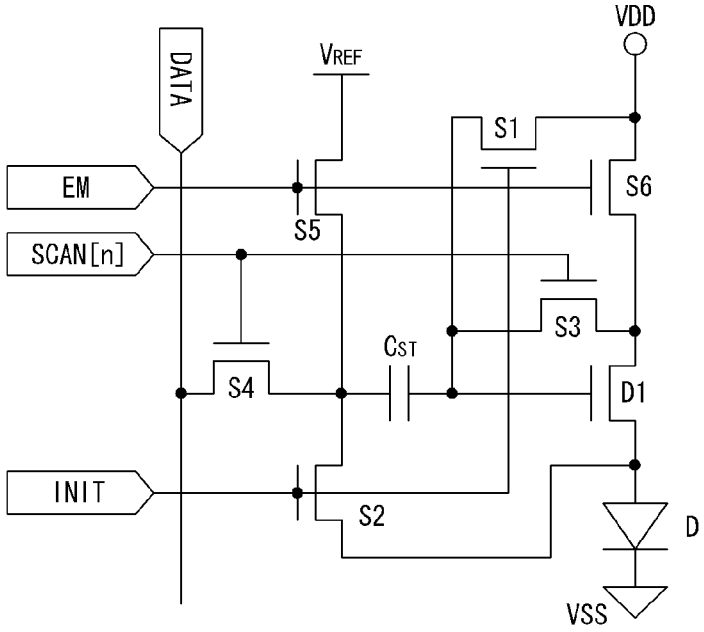
FIG. 8 is an illustration of a subpixel having a 7T1C structure comprising a compensation circuit.
Figure 9:
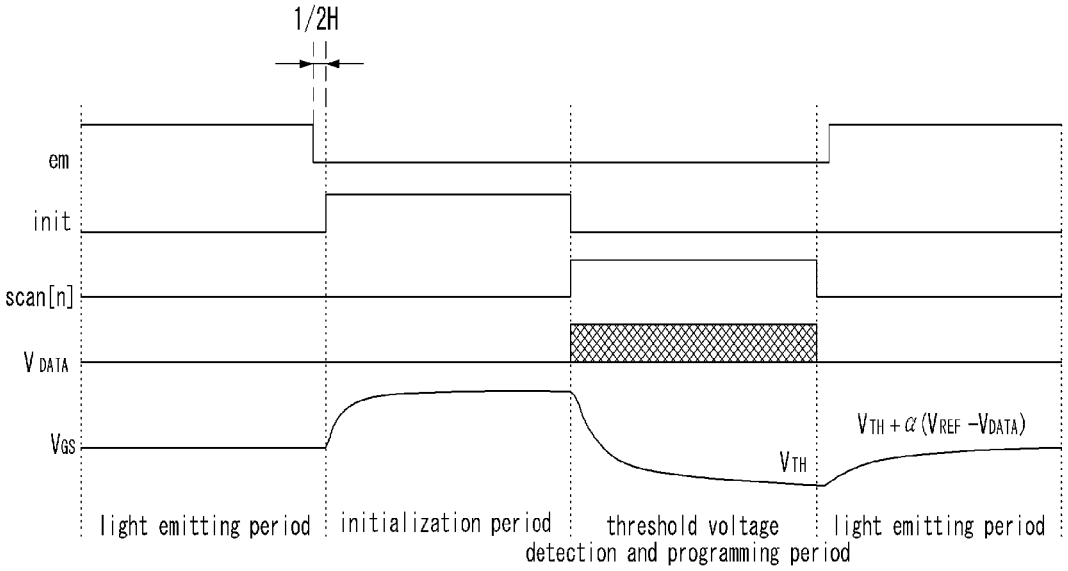
FIG. 9 is an illustration of the driving waveforms of the subpixel.

FIG. 8 is an illustration of a subpixel having a 7T1C structure comprising a compensation circuit. FIG. 9 is an illustration of the driving waveforms of the subpixel.

As shown in FIGS. 8 and 9, the subpixel having a 7T1C structure comprising a compensation circuit includes a first switching transistor S1, a second switching transistor S2, a third switching transistor S3, a fourth switching transistor S4, a fifth switching transistor S5, a sixth switching transistor S6, a driving transistor D1, a capacitor CST, and an organic light emitting diode D. As shown therein, the first to sixth switching transistors S1 to S6 and the driving transistor D1 are formed as N-Type amorphous silicon (nA-Si) transistors.

The elements included in the subpixel are connected as follows.

A gate terminal of the first switching transistor S1 is connected to a first scan line INIT supplied with a first scan signal init, a first terminal thereof is connected to a first power supply line VDD supplied with high-potential power, and a second terminal thereof is connected to one terminal of the capacitor CST. A gate terminal of the second switching transistor S2 is connected to the first scan line INIT, a first terminal thereof is connected to a second terminal of the driving transistor D1, and a second terminal thereof is connected to the other terminal of the capacitor CST. A gate terminal of the third switching transistor S3 is connected to a second scan line SCAN[n] supplied with a second scan signal scan[n], a first terminal thereof is connected to a first terminal of the driving transistor D1, and a second terminal thereof is connected to a gate terminal of the driving transistor D1. A gate terminal of the fourth switching transistor S4 is connected to the second scan line SCAN[n], a first terminal thereof is connected to a data line DATA supplied with a data voltage VDATA, and a second terminal thereof is connected to the other terminal of the capacitor CST. A gate terminal of the fifth switching transistor S5 is connected to a third scan line EM supplied with a third scan signal em, a first terminal thereof is connected to a reference line VREF supplied with a reference voltage VREF, and a second terminal thereof is connected to the other terminal of the capacitor CST. A gate terminal of the sixth switching transistor S6 is connected to the third scan line EM, a first terminal thereof is connected to the first power supply line VDD, and a second terminal thereof is connected to the first terminal of the driving transistor D1. An anode of the organic light emitting diode D is connected to the second terminal of the driving transistor D1, and a cathode thereof is connected to a second power supply line VSS supplied with low-potential power.

The above-described subpixel having a compensation circuit is driven in the order of an initialization period, a threshold voltage detection and programming period, and a light emitting period.

During the initialization period, the second and third scan signals scan[n] and em of logic low are supplied to the second and third scan lines SCAN[n] and EM, and the first scan signal init of logic high is supplied to the first scan line INIT.

During the threshold voltage detection and programming period, the first and third scan signals init and em of logic low are supplied to the first and third scan lines INIT and EM, and the second scan signal scan[n] of logic high is supplied to the second scan line SCAN[n].

During the light emitting period, the first and second scan signals init and scan[n] of logic low are supplied to the first and second scan lines INIT and SCAN[n], and the third scan signal em of logic high is supplied to the third scan line EM.

The elements included in the subpixel are driven as follows by the scan signals init, scan[n], and em supplied through the first to third scan lines INIT, SCAN[n], and EM during the initialization period, threshold voltage detection and programming period, and light emitting period.

The first switching transistor S1 is turned on in response to the first scan signal init to supply high-potential power to the gate terminal of the driving transistor D1 and one terminal of the capacitor CST and initialize a threshold voltage VTH of the driving transistor D1. The second switching transistor S2 is turned on in response to the first scan signal init to connect the other terminal of the capacitor CST and the second terminal of the driving transistor D1. The third switching transistor S3 is turned on in response to the second scan signal SCAN[n] to connect the gate terminal and first terminal of the driving transistor D1 and set the threshold voltage VTH of the driving transistor D1. The fourth switching transistor S4 is turned on in response to the second scan signal SCAN[n] to supply the data voltage VDATA to the other terminal of the capacitor CST. The fifth switching transistor S5 is turned in response to the third scan signal em to supply the reference voltage VREF to the other terminal of the capacitor CST. The sixth switching transistor S6 is turned in response to the third scan signal em to deliver the high-potential power VDD supplied to the first terminal to the second terminal. The driving transistor D1 is turned on based on the data voltage VDATA to generate a driving current. The organic light emitting diode D emits light based on the driving current supplied through the driving transistor D1.

Meanwhile, a method for driving the above-described sub-pixel will be described. The first scan signal init supplied through the first scan line INIT requires a delay period of ½ horizontal time (½H) from the third scan signal em supplied through the third scan line EM in the previous frame so that switches S1/S2 do not turn on before switches S5/S6 are completely turned off.

In this case, the scan driver SDRV can output the first scan signal init, which is delayed from the third scan signal em of a previous frame by ½ horizontal time, by varying the state of a clock output through the clock selectors MUX1 to MUX3, as explained with reference to FIGS. 2 to 6.

While an organic light emitting display using a scan driver according to an exemplary embodiment of the present invention has been described with respect to a subpixel having a 7T1C structure comprising a compensation circuit, the structure of the subpixel comprising the compensation circuit is not limited thereto. Also, while the exemplary embodiment of the present invention has been described with respect to an example where the scan driver SDRV for driving the organic light emitting display outputs three scan signals, two, three, four, and F (F is 5 or more) scan signals can be output depending on the configuration of the subpixel comprising the compensation circuit.

As seen above, the exemplary embodiment of the present invention provides a scan driver, which generates and outputs a specific scan signal every ½ to 1 horizontal time, and an organic light emitting display using the same. Moreover, the exemplary embodiment of the present invention provides a scan driver, which generates and outputs a specific scan signal every 1/K (K is an integer equal to or greater than 3) to 1 horizontal time by varying the on/off duty ratio of a clock, and an organic light emitting display using the same. Furthermore, the exemplary embodiment of the present invention provides a scan driver, which generates and outputs a scan signal required by a subpixel comprising a compensation circuit every ½ horizontal time or less, and an organic light emitting display using the same. Although the exemplary embodiment has been described with respect to an example where the scan driver is applied to the organic light emitting display, it is needless to say that the present invention is not limited to the above-mentioned embodiment and may be applied to other types of displays.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A scan driver for a display device, the scan driver comprising:

clock selectors that output either a first clock or a second clock obtained by inverting the first clock in accordance with logic value of a selection signal, the first clock having a logic high period followed by a logic low period within one horizontal time, the horizontal time corresponding to a duration during which a scan signal is asserted for display of an image on the display device; and shift registers that generate pulse signals for driving sub-pixels of the display device in a given row, based on either the first clock or the second clock supplied from the clock selectors together with first to N-th start pulses of different phases where N is an integer equal to or greater than 4, one or more of the shift registers generating at least a first pulse signal for the given row based on a first start pulse responsive to the first clock and generating a second pulse signal for the given row offset by ½ horizontal time from the first pulse signal based on a second start pulse responsive to the second clock, the first pulse signal being asserted during a light-emitting period of the sub-pixels and the second pulse signal not being asserted during the light-emitting period of the sub-pixels.

2. The scan driver of claim 1, further comprising level shifters that increase the level of the pulse signals supplied from the shift registers and output the pulse signals as scan signals.

3. The scan driver of claim 1, wherein, when the first clock is supplied from the clock selectors, the shift registers output the pulse signals in synchronization with a falling edge of the first clock, and when the second clock is supplied from the clock selectors, the shift registers output the pulse signals in synchronization with a rising edge of the second clock.

4. The scan driver of claim 1, wherein the shift registers comprise flip-flops which delay the first to N-th start pulses in accordance with either the first clock or the second clock and output the delayed start pulses as the pulse signals.

5. The scan driver of claim 1, wherein the first clock and the second clock have different duty ratios of logic high and logic low within one horizontal time, and another one of the shift registers generates a third pulse signal having a delay of 1/K horizontal time from a fourth pulse signal where K is an integer equal to or greater than 3.

6. The scan driver of claim 1, wherein a first set of the shift registers are associated with a logic value of high for the selection signal, a second set of the shift registers are associated with a logic value of low for the selection signal, and a number of the first set of the shift registers is M (M is an integer equal to 1 or more).

7. The scan driver of claim 1, wherein the clock selectors comprise 2-to-1 multiplexers each having a first input terminal for receiving the first clock, a second input terminal for receiving the second clock, a selection terminal for receiving the selection signal, and an output terminal for outputting either the first clock or the second clock in accordance with the logic value of the selection signal.

8. An organic light emitting display comprising:

an organic light emitting display panel;

a data driver that supplies data signals to the display panel; and a scan driver, the scan driver comprising:

clock selectors that output either a first clock or a second clock obtained by inverting the first clock in accordance with logic value of a selection signal, the first clock having a logic high period followed by a logic low period within one horizontal time, the horizontal time corresponding to a duration during which a scan signal is asserted for display of an image on the organic light emitting display, and shift registers that generate pulse signals for driving sub-pixels of the organic light emitting display in a given row, based on either the first clock or the second clock supplied from the clock selectors together with first to N-th start pulses of different phases where N is an integer equal to or greater than 4, one or more of the shift registers generating at least a first pulse signal for the given row based on a first start pulse responsive to the first clock and generating a second pulse signal for the given row offset by ½ horizontal time from the first pulse signal based on a second start pulse responsive to the second clock, the first pulse signal being asserted during a light-emitting period of the sub-pixels and the second pulse signal not being asserted during the light-emitting period of the sub-pixels.

9. The organic light emitting display of claim 8, wherein the scan driver further comprises level shifters that increase the level of the pulse signals supplied from the shift registers and output the pulse signals as scan signals.

10. The organic light emitting display of claim 8, wherein, when the first clock is supplied from the clock selectors, the shift registers output the pulse signals in synchronization with a falling edge of the first clock, and when the second clock is supplied from the clock selectors, the shift registers output the pulse signals in synchronization with a rising edge of the second clock.

11. The organic light emitting display of claim 8, wherein the shift registers comprise flip-flops which delay the first to N-th start pulses in accordance with either the first clock or the second clock and output the delayed start pulses as the pulse signals.

12. The organic light emitting display of claim 8, wherein the first clock and the second clock have different duty ratios of logic high and logic low within one horizontal time, and another one of the shift registers generates a third pulse signal having a delay of 1/K horizontal time from a fourth pulse signal where K is an integer equal to or greater than 3.

13. The organic light emitting display of claim 8, wherein a first set of the shift registers are associated with a logic value of high for the selection signal, a second set of the shift registers are associated with a logic value of low for the selection signal, and a number of the first set of shift registers is M (M is an integer equal to 1 or more).

14. The organic light emitting display of claim 8, wherein the clock selectors comprise 2-to-1 multiplexers each having a first input terminal for receiving the first clock, a second input terminal for receiving the second clock, a selection terminal for receiving the selection signal, and an output terminal for outputting either the first clock or the second clock in accordance with the logic value of the selection signal.

15. An organic light emitting display comprising:

an organic light emitting display panel including a plurality of sub-pixels; and a scan driver including logic circuitry to receive a plurality of start pulses including at least a first start pulse, first clock and a second clock that is an inversion of the first clock to generate two or more pulse signals as scan signals for driving the sub-pixels of the organic light emitting display panel in a given row, the logic circuitry generating a first pulse signal for the given row based on the first start pulse responsive to the first clock and generating a second pulse signal for the given row offset by ½ horizontal time from the first pulse signal based on the second start pulse responsive to the second clock, the first pulse signal being asserted during a light-emitting period of the sub-pixels and the second pulse signal not being asserted during the light-emitting period of the sub-pixels, the horizontal time corresponding to a duration during which the scan signals are asserted for display of an image on the organic light emitting display.

16. The organic light emitting display of claim 15, wherein the logic circuitry is configured to output the pulse signals in synchronization with the first clock or the second clock.

17. The organic light emitting display of claim 16, wherein the first clock and the second clock have different duty ratios of logic high and logic low within one horizontal time, and the logic circuitry generates a third pulse signal to have a delay of 1/K horizontal time from a fourth pulse signal, where K is an integer equal to or greater than 3.

* * * * *